United States Patent [19]

Jäger

[11] 4,192,469

[45] Mar. 11, 1980

[54] SPRING ROLL MILL

[76] Inventor: Heinz Jäger, Nevelstrasse 40, 4630 Bochum, Fed. Rep. of Germany

[21] Appl. No.: 880,223

[22] Filed: Feb. 21, 1978

[30] Foreign Application Priority Data

Feb. 21, 1977 [DE] Fed. Rep. of Germany ..... 2707395

[51] Int. Cl.[2] ..... B02C 15/06

[52] U.S. Cl. ..... 241/121; 241/79.3

[58] Field of Search ..... 241/47, 57, 62, 109, 241/114, 117, 121, 79.3, 80, 52

[56] References Cited

U.S. PATENT DOCUMENTS

| | | | |
|---|---|---|---|
| 1,733,417 | 10/1929 | Loesche | 241/121 X |
| 1,834,094 | 12/1931 | Fraser | 241/109 X |
| 2,112,359 | 3/1938 | Crites | 241/109 X |
| 2,875,959 | 3/1959 | Calkins | 241/119 X |

*Primary Examiner*—Eugene F. Desmond

*Attorney, Agent, or Firm*—Herbert L. Lerner

[57] ABSTRACT

Spring roll mill having stationary grinding rolls yieldingly pressed from within the mill toward a circumferential grinding ring mounted on a grinding dish and revolving together therewith, a central feed inlet for supplying to the mill from above material to be ground therein, and a discharge outlet for discharging the ground material from the mill together with an air flow, includes means for introducing the air flow from below into substantially the middle of the grinding dish.

2 Claims, 2 Drawing Figures

SPRING ROLL MILL

Figure 1:
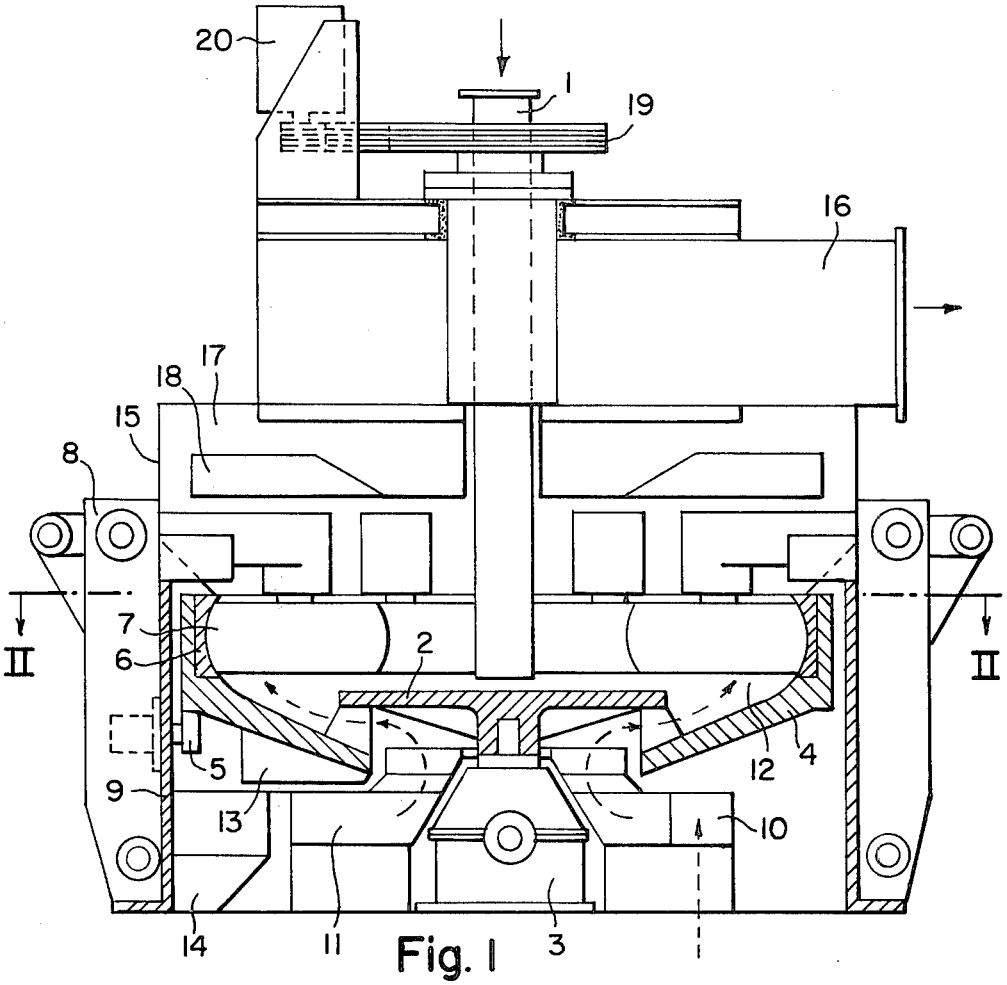

The invention relates to a spring roll mill as used for fine grinding or milling of carbon, minerals, cement raw materials or the like. More particularly, the invention relates to a spring roll mill wherein a grinding ring is disposed at a vertically extending edge of a revolving grinding or milling dish, and horizontally disposed grinding rolls are pressed yieldingly or resiliently toward the grinding ring. Material to be ground or milled surrendered from above in the middle of the grinding dish is thus borne by centrifugal force to the grinding ring where it is ground or milled between the grinding ring and the grinding rolls pressed against the grinding ring. Discharge of the ground or milled material occurs with the aid of an air flow into a screen or sifter, the air flow rising beyond the grinding dish in the mill housing. In this regard, reference can be had to German Published Prosecuted Application No. DT-AS 044 568.

In the heretofore known mills of this general type, a disadvantage arises in that the feed of the material to be ground to the grinding ring is effected solely by centrifugal force. A consequence thereof, is that with a feed having a high component of fines, part of the material being ground or milled remains in the grinding dish because, due to the slight mass thereof, it could not be influenced by centrifugal force. The mill thus becomes clogged in a short time.

A further disadvantage is that, in the grinding gap between the grinding ring and the grinding rolls of heretofore known spring roll mills of this general type, the material finely ground therein remains there and forms a cushion which hinders the further grinding or milling operation because it is not entrained by the air flow rising upwardly outside and beyond the grinding dish and is therefore not discharged. Also, in the heretofore known mills of this general type, it was impossible to effect the drying of a very moist or damp feed because of the absence of intensive contact with a hot air current.

It is accordingly an object of the invention to provide a spring roll mill wherein the grinding operation is much improved over that in heretofore known mills of that type and also wherein grinding of damp feed is afforded.

With the foregoing and other objects in view, there is provided, in accordance with the invention, a spring roll mill having stationary grinding rolls yieldingly pressed from within the mill toward a circumferential grinding ring mounted on a grinding dish and revolving together therewith, a central feed inlet for supplying to the mill from above material to be ground therein, and a discharge outlet for discharging the ground material from the mill together with an air flow, comprising means for introducing the air flow from below into substantially the middle of the grinding dish.

In accordance with another feature of the invention, the air flow introducing means comprise an opening in the bottom of the grinding dish, and including a distributor plate disposed in the grinding dish in the space therein above the opening, and firmly secured to the grinding dish, the distributor plate being located below the central feed inlet for receiving, thereon a supply of the material to be ground.

In accordance with an added feature of the invention, the spring roll mill includes a guide vane ring for guiding the air flow disposed between the distributor plate and the bottom of the grinding dish. In this manner, it is possible to reliably prevent the feed of material to be ground from falling into the air supply line.

In accordance with an additional feature of the invention, especially advantageous for mills having a grinding dish of relatively larger diameter, there are provided bracing rollers supporting the grinding dish at the periphery thereof.

In accordance with a concomitant feature of the invention, the central feed inlet comprises a substantially vertical tube adjustable in elevation thereof so as to attain thereby a metering of the material to be ground, which is delivered onto the distributor plate.

The mill according to the invention affords the advantage that the air flow rising from within to the outside effects a given advance sifting of the material to be ground so that the fines contained in the material to be ground are immediately carried away and discharged and do not hinder the grinding operation. The air flow likewise discharges or carries away the ground fine material immediately. With the use of hot air or hot gas, drying of the material to be ground occurs in the grinding dish so that also damp or even very damp material can be ground or milled effectively in the mill according to the invention.

Other features which are considered as characteristic for the invention are set forth in the appended claims.

Although the invention is illustrated and described herein as embodied in a spring roll mill, it is nevertheless not intended to be limited to the details shown, since various modifications and structural changes may be made therein without departing from the spirit of the invention and within the scope and range of equivalents of the claims.

Figure 2:
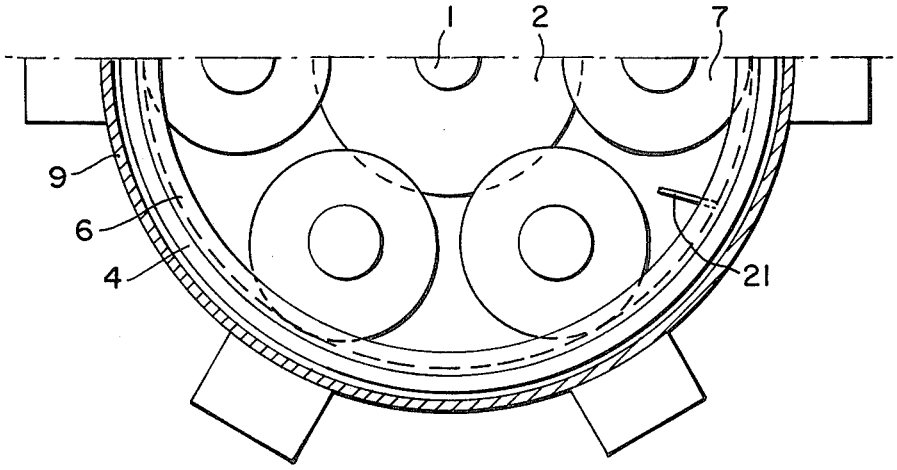

The construction and method of operation of the invention, however, together with additional objects and advantages thereof will be best understood from the following description of specific embodiments when read in connection with the accompanying drawings, in which:

FIG. 1 is a vertical sectional view of the spring roll mill according to the invention, and FIG. 2 is a half cross-sectional view of FIG. 1 taken along the line II—II in direction of the arrows.

Referring now to FIG. 1 of the drawing, there is shown therein a delivery tube 1 which is adjustable in elevation, through which material to be ground or milled is fed to a revolving distribution plate 2. The distribution plate 2 is driven together with a grinding or milling dish 4 through a transmission 3 by a non-illustrated electric drive motor. The grinding disk 4 has a vertical wall portion to which a grinding or milling ring 6 is secured. The grinding dish 4 is additionally braced or supported by support rollers 5 (only one of which is illustrated in FIG. 1). Grinding or crushing rolls 7 are yieldingly pressed against the grinding ring 6 hydraulically or resiliently (by springs) through a conventional pressure-applying device 8. Suitable stop means are provided which, during no-load operation or idling, can prevent the grinding or milling rolls 7 from running up against the grinding ring 6. The device 8 serves for swinging the grinding rolls 7 out of the mill housing 9 when repairs are to be made or servicing is to be effected on the grinding rolls 7. Air and heating gas are fed through inlet pipe unions or connecting pieces 10 into an annular or ring chamber 11 from which they enter into the inner space 12 of the grinding or milling dish 4. By means of a sweeper 13 revolving together with the milling dish 4, any material that falls into the space between the milling dish 4 and the annular chamber 11 is swept into an outlet or discharge hopper 14. A screen or sifter 15 and an outlet pipe union or connecting piece 16 are disposed above the mill housing 9. The screen 15 encloses a sifting chamber 17 wherein a revolving centrifugal system 18 including a bladed rotating plate is received which is driven by an externally mounted V-belt drive 19 suitably connected to an electric drive motor 20. The material being ground which is firmly retained at the grinding ring 6 due to centrifugal force is stripped off the latter by a stripper 21 (FIG. 2) and returned to the grinding dish 4.

There are claimed:

1. Spring roll mill having stationary grinding rolls yieldingly pressed from within the mill toward a circumferential grinding ring mounted on a grinding dish and revolving together therewith, a central feed inlet for supplying to the mill from above material to be ground therein, and a discharge outlet for discharging the ground material from the mill together with an air flow, comprising a distributor plate revolving together with the grinding dish, said distributor plate being disposed below the central feed inlet and below at least part of the grinding rolls for receiving thereon a supply of the material to be ground, means for centrally introducing the air flow from below said distributor plate and conducting the air flow between the grinding rolls and the grinding dish and between the grinding rolls themselves, a sifter having a centrifugal system disposed above the grinding dish, and separate means for driving the centrifugal system.

2. Spring roll mill according to claim 1 including a guide vane ring for guiding the air flow disposed between said distributor plate and the bottom of the grinding dish.

* * * * *